US012697538B2

(12) United States Patent
Rimbaut et al.

(10) Patent No.: US 12,697,538 B2
(45) Date of Patent: Aug. 4, 2026

(54) SHOE WITH REMOVABLE MEANS OF TRANSPORT

(71) Applicant: FLANEURZ, Pantin (FR)

(72) Inventors: Noé Rimbaut, Pantin (FR); Nicolas Brasi, Pantin (FR); Florian Gravier, Pantin (FR); Arnaud Darut Giard, Pantin (FR)

(73) Assignee: FLANEURZ, Pantin (FR)

( * ) Notice: Subject to any disclaimer, the term of this patent is extended or adjusted under 35 U.S.C. 154(b) by 258 days.

(21) Appl. No.: 18/558,507

(22) PCT Filed: May 3, 2022

(86) PCT No.: PCT/EP2022/061762

§ 371 (c)(1),
(2) Date: Nov. 1, 2023

(87) PCT Pub. No.: WO2022/233816

PCT Pub. Date: Nov. 10, 2022

(65) Prior Publication Data

US 2024/0226707 A1 Jul. 11, 2024

(51) Int. Cl.
*A63C 17/20* (2006.01)
*A43B 3/24* (2006.01)

(52) U.S. Cl.
CPC ..... *A63C 17/20* (2013.01); *A43B 3/246* (2013.01); *A63C 2203/06* (2013.01)

(58) Field of Classification Search
CPC ..... A63C 17/20; A63C 2203/06; A63C 1/08; A63C 1/16; A63C 1/20; A63C 17/008; A63C 17/26; A63C 17/18; A43B 3/246
See application file for complete search history.

(56) References Cited

U.S. PATENT DOCUMENTS 2,244,719 A * 6/1941 Mansfield ..... A63C 1/20 280/11.3
6,382,638 B1 * 5/2002 Lee ..... A43B 5/1633 280/11.3

(Continued)

FOREIGN PATENT DOCUMENTS

CA 2351236 C * 11/2011 ..... A63C 1/00
DE 20304895 U1 6/2003

(Continued)

OTHER PUBLICATIONS

KR-100538038-B1 English Translation (Year: 2005).*

(Continued)

*Primary Examiner* — Michael T. Walsh
(74) *Attorney, Agent, or Firm* — NIXON & VANDERHYE

(57) ABSTRACT

Disclosed is a sports equipment device, including a footwear portion with a sole, a transport portion including a frame and a movement mechanism fixed under this frame, and including a securing mechanism which is able to removably secure the footwear portion to the frame and which includes an upper front block and an upper rear block which are attached to the footwear portion, and a lower front block and a lower rear block which are attached to the frame and are able to be secured to the upper front block and the upper rear block respectively. At least a portion of the sole is created by molding and is molded onto the upper blocks.

10 Claims, 6 Drawing Sheets

(56) References Cited

U.S. PATENT DOCUMENTS

| | | | | |
|---|---|---|---|---|
| 6,955,361 | B2 * | 10/2005 | Borel | A43B 5/0421 280/11.26 |
| 8,544,854 | B2 * | 10/2013 | Adams | A63C 17/02 280/11.31 |
| 2003/0155724 | A1 * | 8/2003 | Wang | A63C 17/20 280/11.3 |
| 2013/0147137 | A1 | 6/2013 | Adams | |

FOREIGN PATENT DOCUMENTS

| | | | | |
|---|---|---|---|---|
| FR | 2837717 | A3 | 10/2003 | |
| FR | 3019470 | A1 | 10/2015 | |
| KR | 100538038 | B1 * | 12/2005 | A63C 17/20 |
| WO | WO-2015150647 | A1 * | 10/2015 | A43B 5/1641 |

OTHER PUBLICATIONS

CA-2351236-C English Translation (Year: 2011).*
WO-2015150647-A1 English Translation (Year: 2015).*
Search Report and Written Opinion of FR Application No. 2104639 dated Dec. 16, 2021, 10 pages.
International Search Report for PCT/EP2022/061762 dated Sep. 13, 2022, 6 pages.
Written Opinion of the ISA for PCT/EP2022/061762 dated Sep. 13, 2022, 7 pages.

* cited by examiner

[Fig. 1]
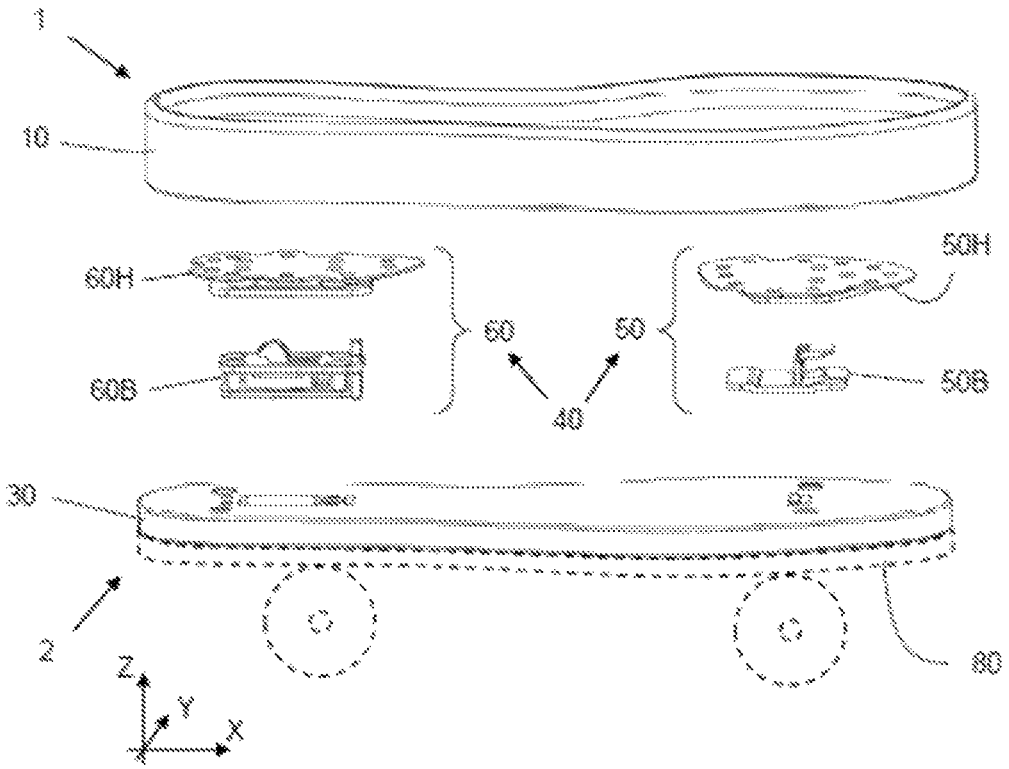
[Fig. 2]
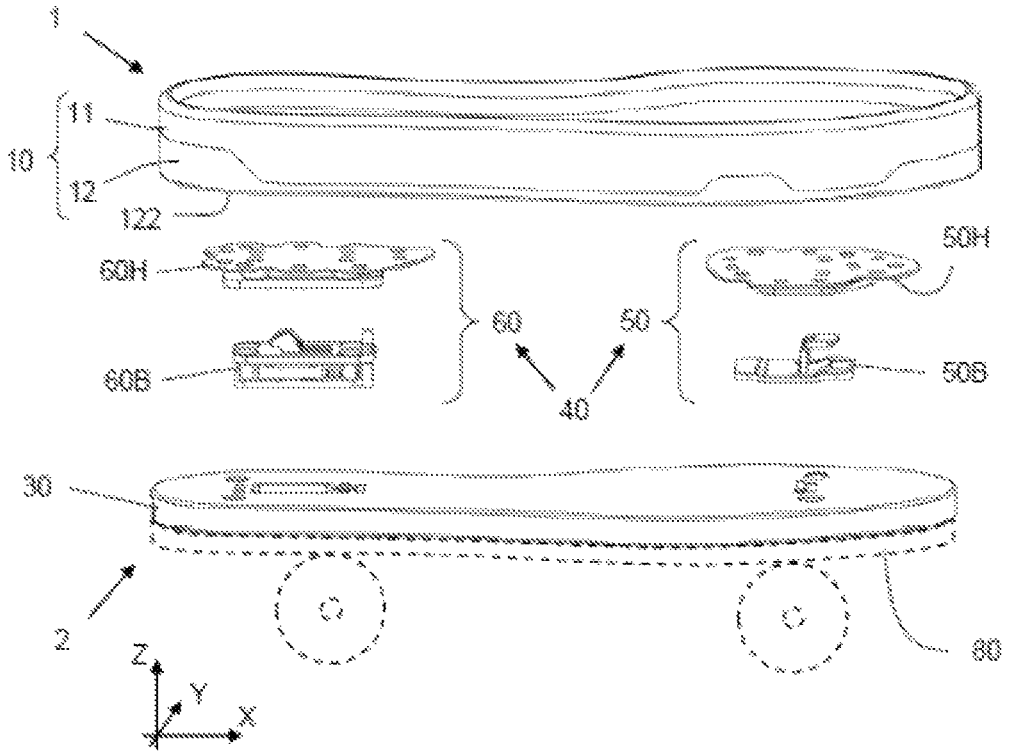

[Fig. 3]
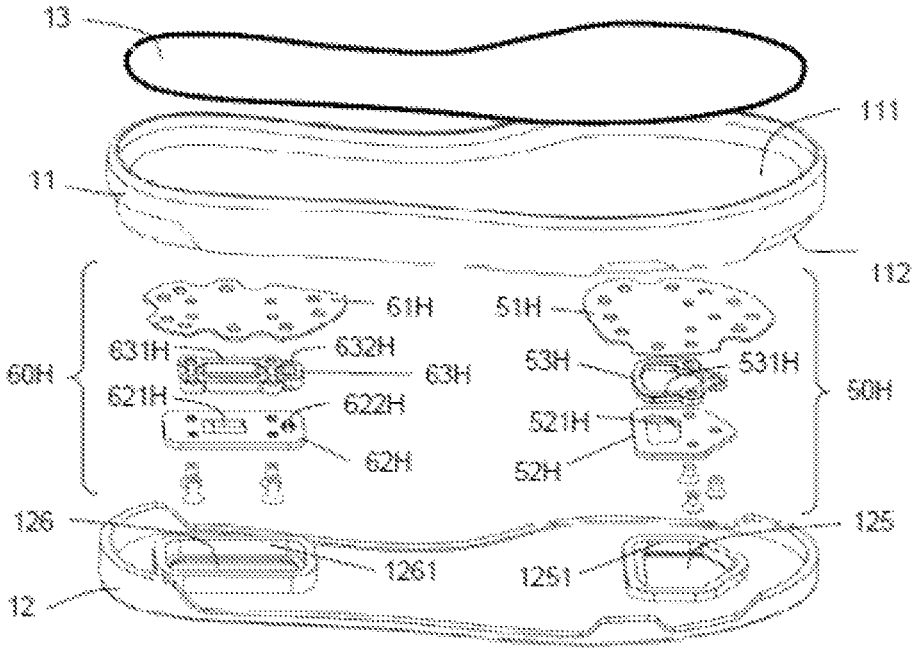
[Fig. 4]
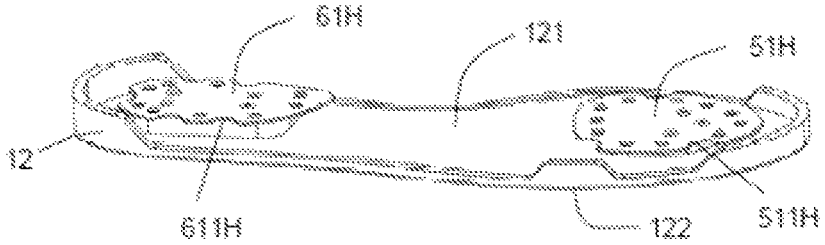
[Fig. 5]
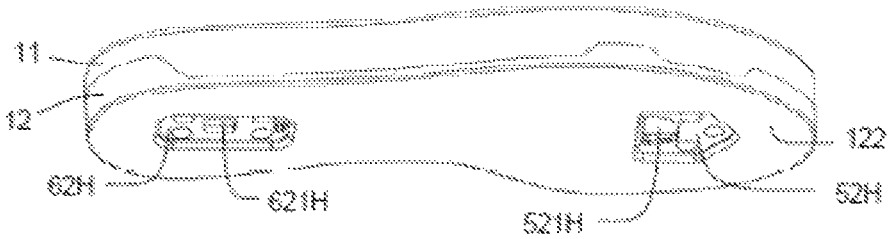

[Fig. 6]
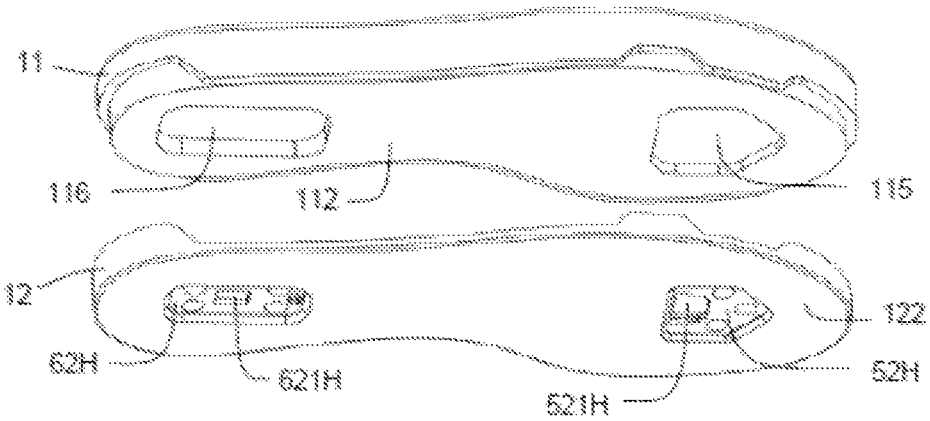
[Fig. 7]
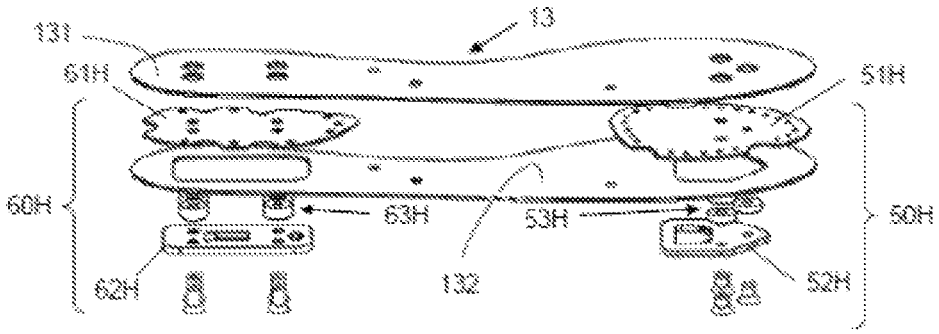
[Fig. 8]
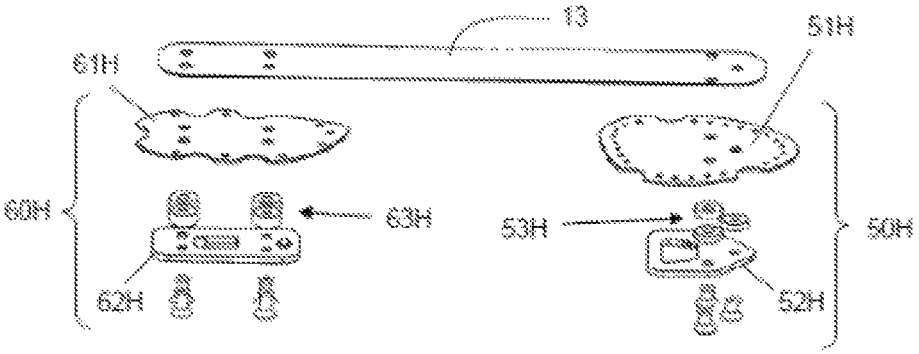

[Fig. 9]
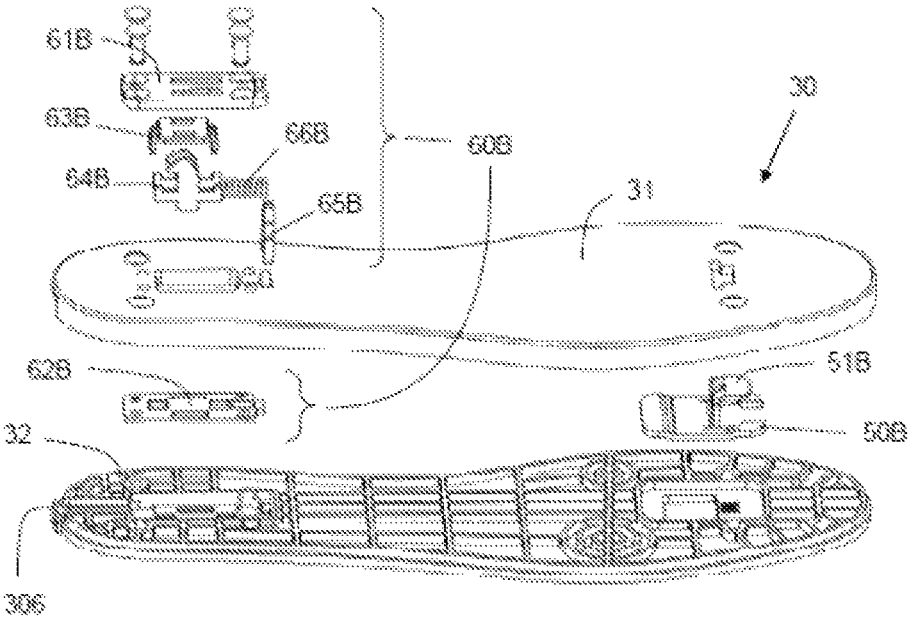
[Fig. 10]
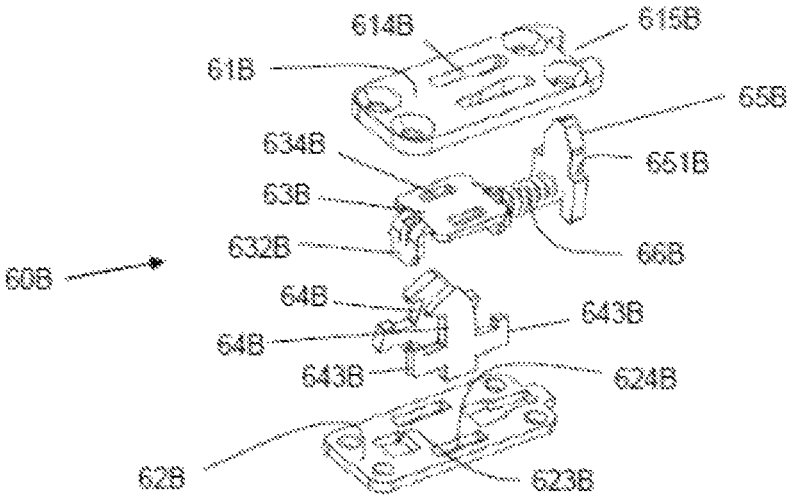

[Fig. 11]
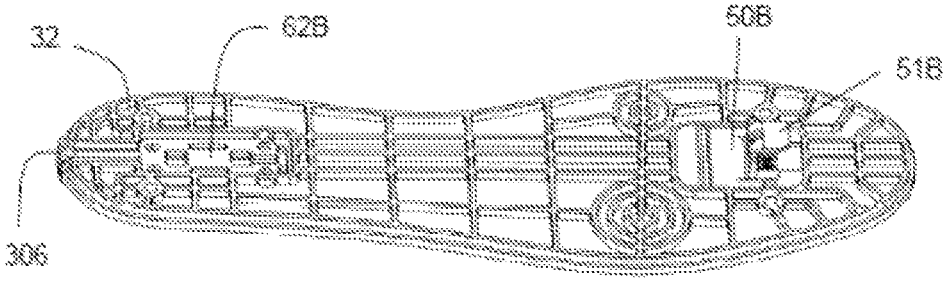
[Fig. 12]
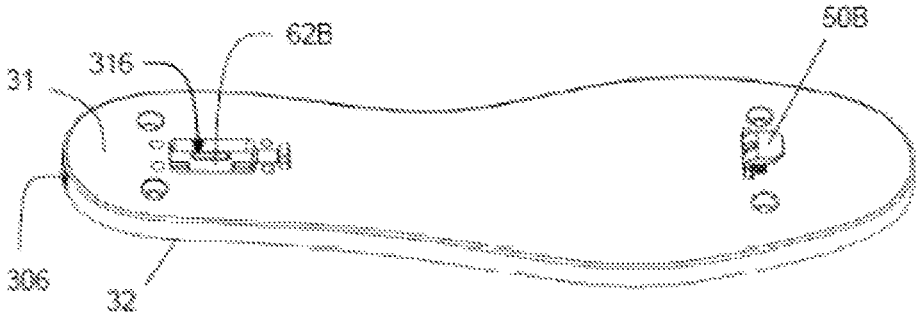
[Fig. 13]
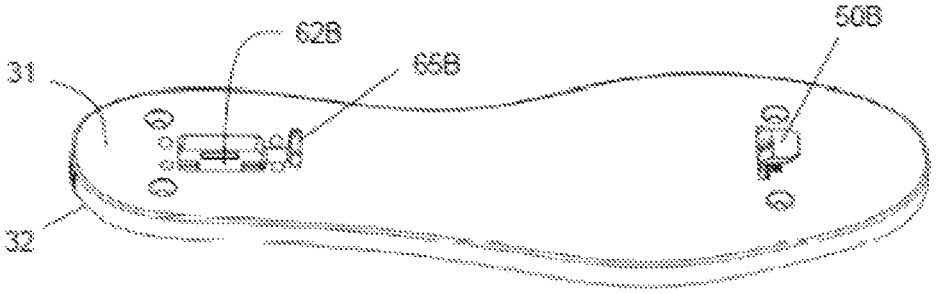

[Fig. 14]
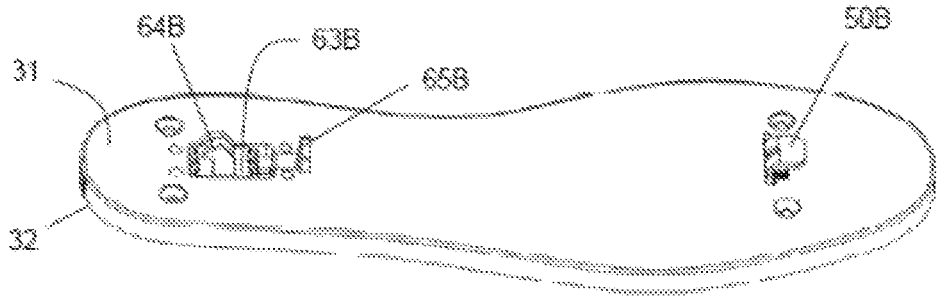
[Fig. 15]
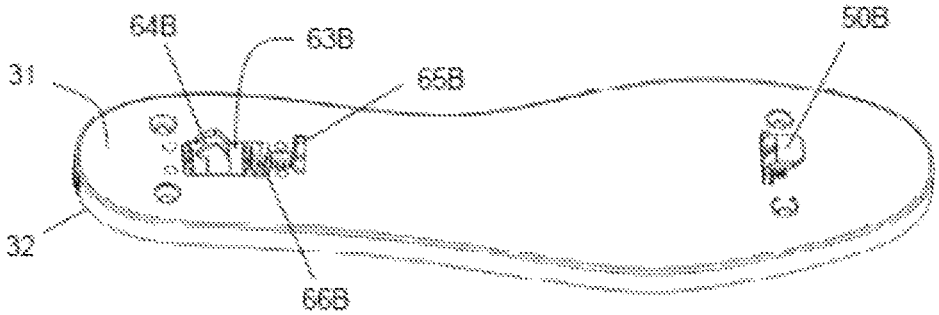
[Fig. 16]
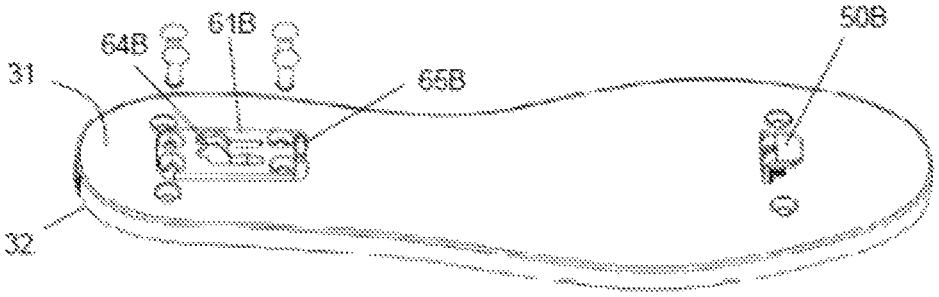

SHOE WITH REMOVABLE MEANS OF TRANSPORT

CROSS-REFERENCE TO RELATED APPLICATIONS

This application is the US national stage of PCT/EP2022/061762, filed May 3, 2022 and designating the United States, which claims the priority of FR 2104639, filed May 3, 2021. The entire contents of each foregoing application are incorporated herein by reference.

BACKGROUND OF THE INVENTION

Field of the Invention

This invention relates to shoes which are provided with a means of transport, also called a transport portion. This means of transport comprises a frame which is fixed under the sole of the shoe, and a movement mechanism which is fixed under this frame. This movement mechanism allows the person wearing the shoe to move over the ground by any means, for example wheels, a skate, stilts, or any similar element which allows rolling, sliding, or weight bearing.

This means of transport is removable from the shoe (also called the footwear portion). The user can thus walk normally when the means of transport is detached from the shoe and for example being carried along with the user. When the means of transport is attached under the shoe, the user can slide or roll over the ground. Such an assembly comprising this shoe and this means of transport gives the user varied possibilities for movement and constitutes an advantageous sports equipment device.

Description of the Related Art

A sports equipment device is thus known, comprising a footwear portion comprising a sole on the one hand, and a transport portion comprising a frame which extends along a longitudinal axis (X) oriented from front to rear and a movement mechanism which is fixed under this frame on the other hand, and further comprising a securing mechanism which is able to removably secure the footwear portion to the frame and which comprises a front attachment mechanism which comprises an upper front block attached to the footwear portion and a lower front block attached to the frame and able to be secured to the upper front block, and a rear attachment mechanism which comprises an upper rear block attached to the footwear portion and a lower rear block attached to the frame and able to be secured to the upper rear block.

An example of such a device is described in patent FR3019470. However, in that device the integration of the upper front block and upper rear block into the footwear portion involves several steps and is complex.

SUMMARY OF THE INVENTION

The present invention aims to remedy these disadvantages.

The invention aims to propose a sports equipment device in which the integration into the footwear portion of the upper front block and upper rear block is simplified, while allowing easy connection and detachment of the frame to/from the footwear portion.

This goal is achieved by means of the fact that the upper front block and upper rear block are integrated into the sole, and that at least a portion of the sole is created by molding and is molded onto the upper front block and upper rear block.

By means of these arrangements, integration into the footwear portion of the upper front block and upper rear block is simplified, as is the manufacturing process. In addition, correct positioning of the upper front block and upper rear block, and the maintaining of the distance between these blocks, are achieved by means of molding the portion (which is created by molding) onto these blocks. This allows easy connection and detachment of the frame to/from the footwear portion, and remains reliable over time.

For example, the footwear portion further comprises a retaining element which extends within a plane when at rest and which is flexurally deformable and tensionally non-deformable in this plane.

The maintaining of the positions of the upper front block and upper rear block over time is thus improved.

For example, the retaining element is fixed directly to the upper front block and to the upper rear block.

The maintaining over time of the positions of the upper front block and upper rear block are thus further improved.

For example, the upper front block comprises an upper front plate, a lower front plate pierced with a central front hole, and a front spacer located between the front plates, the front plates and the front spacer being mechanically connected together, and the upper rear block comprises an upper rear plate, a lower rear plate pierced with a central rear hole and a side rear hole, and a rear spacer located between the rear plates, the rear plates and the rear spacer being mechanically connected together.

A constant distance between the front plates and a constant distance between the rear plates is thus maintained, which makes the front and rear attachment mechanisms more reliable.

For example, the front spacer is a single part and has a closed front wall at its center which surrounds the front hole, and the rear spacer has a closed rear central wall which surrounds the central rear hole and on its front portion has a closed rear side wall which surrounds the side rear hole.

By means of these spacers, this contributes to preventing the molding material from entering the holes of the lower front and rear plates which are intended to receive the lower front and lower rear blocks attached to the frame.

For example, the upper front plate has front reliefs, and the upper rear plate has rear reliefs.

The front and upper rear plates are thus held in position more reliably during molding.

For example, the sole comprises an outsole and an insole which are each created by molding, the insole being overmolded onto the outsole and onto the upper front block and upper rear block.

The manufacturing of the sole is thus carried out solely by molding. Manufacturing is therefore simplified.

For example, the outsole has a front hole surrounded by a front wall in which the lower front plate is housed, which opens onto the outer face, and has a rear hole surrounded by a rear wall in which the lower rear plate is housed, which opens onto the outer face.

Due to these front and rear walls, this helps prevent the molding material from entering the holes of the front and lower rear plates which are intended to receive the lower front and lower rear blocks attached to the frame.

For example, the frame comprises an upper shell and a lower shell which can be mechanically secured together in a removable manner.

Assembly of the frame is thus simplified. In addition, maintenance and repair of the frame, where necessary, is easier.

The invention also relates to a method for manufacturing a sports equipment device.

According to the invention, the method comprises the following steps:

(b) An upper front block and an upper rear block are provided, and a sole is manufactured in which at least a portion is molded onto the upper front block and upper rear block in such a way that these upper blocks are integrated into the sole which is part of a footwear portion;

(c) A frame, a lower front block, and a lower rear block are provided, and the lower blocks are attached to the frame;

(d) A movement mechanism is fixed under the frame;

(e) The lower front block is secured to the upper front block and the lower rear block is secured to the upper rear block so as to removably secure the footwear portion to the frame.

For example, before step (b), the method comprises the following step (a):

(a) An outsole is manufactured by molding;

and the method is such that, in step (b), said sole comprises the outsole and an insole which is created by molding, the insole being overmolded onto the outsole and onto the upper front block and upper rear block.

BRIEF DESCRIPTION OF THE DRAWINGS

The invention will be properly understood and its advantages more apparent upon reading the following detailed description of some embodiments represented as non-limiting examples. The description refers to the accompanying drawings, in which:

FIG. 1 is an exploded perspective view of the sports equipment device according to the invention.

FIG. 2 is an exploded perspective view of the sports equipment device according to another embodiment of the sole of the device of the invention.

FIG. 3 is an exploded perspective view of the footwear portion of the device of FIG. 2.

FIG. 4 is a perspective view of the outsole and upper front block and upper rear block of the device of FIG. 2.

FIG. 5 is a perspective view of the footwear portion of the device of FIG. 1 after the insole is overmolded onto the outsole.

FIG. 6 is a perspective view of the footwear portion of the device of FIG. 5 with the insole detached from the outsole.

FIG. 7 is an exploded perspective view of the upper front block and upper rear block in a variant embodiment of the retaining element of the device of FIG. 1.

FIG. 8 is an exploded perspective view of the upper front block and upper rear block in another variant embodiment of the retaining element of the device of FIG. 1.

FIG. 9 is an exploded perspective view of the frame and of the lower front block and lower rear block of the device of FIG. 1.

FIG. 10 is an exploded perspective view of the lower rear block of the device of FIG. 1.

FIG. 11 is a perspective view of a first step of assembling the lower front block and lower rear block to the frame of the device of FIG. 1.

FIG. 12 is a perspective view of a second step of assembling the lower front block and lower rear block to the frame of the device of FIG. 1.

FIG. 13 is a perspective view of a third step of assembling the lower front block and lower rear block to the frame of the device of FIG. 1.

FIG. 14 is a perspective view of a fourth step of assembling the lower front block and lower rear block to the frame of the device of FIG. 1.

FIG. 15 is a perspective view of a fifth step of assembling the lower front block and lower rear block to the frame of the device of FIG. 1.

FIG. 16 is a perspective view of a sixth step of assembling the lower front block and lower rear block to the frame of the device of FIG. 1.

DETAILED DESCRIPTION OF THE INVENTION

In the description below, and as illustrated in the figures, the footwear portion 1, soles (10, 11, 12), retaining element 13, frame 30, front 50 and rear 60 attachment mechanisms, and the other parts of the sports equipment device are positioned and oriented relative to an orthogonal frame of reference (X, Y, Z), with a horizontal longitudinal axis X oriented from front to rear, a horizontal transverse axis Y, and a vertical axis Z oriented from bottom to top. The terms "front" and "rear" are defined in relation to the longitudinal axis. The terms "top", "upper", "above", "on", "bottom", "lower", "below", and "under" are defined with respect to vertical axis Z.

According to the invention, at least part of sole 10 is created by molding and is molded onto upper front block 50H and upper rear block 60H, these blocks being described below. For example, the rest of the sole is manufactured by extrusion or lamination then is cut to give it its final shape, and is assembled to the molded portion of the sole, this assembly being carried out by any means (for example by sewing and/or gluing and/or heat welding). Alternatively, the entire sole 10 is molded.

"Molded onto upper front block 50H and upper rear block 60H" is understood to mean that the molding material surrounds at least the top and sides of upper front block 50H and upper rear block 60H.

Advantageously, the portion of sole 10 which is created by molding extends from the front to the rear of sole 10, and transversely over the entire horizontal surface of sole 10. As the molding material is waterproof, footwear portion 1 is waterproof in the vertical direction, which allows the user to have dry feet when walking on wet ground.

FIG. 1 illustrates a sports equipment device according to the invention, which comprises a footwear portion 1 comprising a sole 10. In the embodiment of FIG. 1, sole 10 is a single piece, meaning it is molded as one piece. This molding is for example carried out by injection. Footwear portion 1 also comprises, attached onto the top of sole 10, an upper (not shown) which is intended to cover or wrap the user's foot. The attachment is achieved for example by gluing and/or by sewing, for example on the periphery of the upper face of sole 10.

FIG. 2 illustrates the embodiment in which sole 10 is in two parts and is thus composed of an insole (upper sole) 11 and an outsole (lower sole) 12, these two soles being molded separately. Insole 11 has a lower face 112 and an upper face 111. Outsole 12 has a lower face 122 (outer face) and an upper face 121. The upper (not shown) is then attached onto upper face 111, for example onto the periphery of upper face 111.

Alternatively, sole 10 may be composed of three or more soles, these soles being molded separately then assembled or overmolded one on top of another.

The sports equipment device also comprises a transport portion 2 comprising a frame 30 which extends along longitudinal axis X oriented from front to rear, and a movement mechanism 80, in particular for moving across the ground, which is fixed under frame 30. Movement mechanism 80 is schematically represented by dotted lines in FIG. 1 and FIG. 2.

The sports equipment device further comprises a securing mechanism 40 which is able to removably secure footwear portion 1 to frame 30. Securing mechanism 40 comprises a front attachment mechanism 50 and a rear attachment mechanism 60. Front attachment mechanism 50 is located at the front portion of the sports equipment device and comprises an upper front block 50H which is located in footwear portion 1, and a lower front block 50B which is located in frame 30 and which is able to be secured to upper front block 50H. Rear attachment mechanism 60 is located at the rear portion of the sports equipment device and comprises an upper rear block 60H which is attached to footwear portion 1, and a lower rear block 60B which is attached to frame 30 and which is able to be secured to upper rear block 60H. Note that in FIG. 1 and FIG. 2, for clarity, front attachment mechanism 50 and rear attachment mechanism 60 are shown pulled out of footwear portion 10 and frame 30.

Upper front block 50H and upper rear block 60H of securing mechanism 40 will be described first.

In the embodiment where sole 10 is one piece, upper front block 50H and upper rear block 60H are embedded in sole 10. However, upper front block 50H and upper rear block 60H each open onto the lower face of sole 10 in order to allow securing them to lower front block 50B and lower rear block 60B respectively. The molding material thus surrounds both the top and sides of upper front block 50H and upper rear block 60H. For example, a ridge of the molding material also covers the periphery of the lower faces of upper front block 50H and upper rear block 60H.

In the embodiment where sole 10 comprises an insole 11 and an outsole 12, upper front block 50H and upper rear block 60H are integrated into outsole 12 and insole 11, as shown in FIG. 3 which illustrates these various parts in an exploded perspective view, before their assembly into their correct positions. Thus, upper front block 50H and upper rear block 60H are embedded in outsole 12 and insole 11. However, upper front block 50H and upper rear block 60H each open onto the outer face (lower face) 122 of outsole 12 in order to allow securing them to lower front block 50B and lower rear block 60B respectively. The molding material thus surrounds both the top and sides of upper front block 50H and upper rear block 60H. For example, a ridge of the molding material also covers the periphery of the lower faces of upper front block 50H and upper rear block 60H.

Outsole 12 and insole 11 are each created by molding, insole 11 being overmolded onto outsole 12 and onto upper front block 50H and upper rear block 60H. This molding and overmolding are for example carried out by injection.

Upper front block 50H comprises an upper front plate 51H, a lower front plate 52H pierced with a central front hole 521H, and a front spacer 53H which is located between these front plates 51H, 52H. Front plates 51H, 52H and front spacer 53H extend in horizontal plane X, Y and are mechanically connected together along vertical axis Z. This mechanical connection is achieved for example by riveting with rivets which pass through holes in each of front plates 51H, 52H and in front spacer 53H, as illustrated in FIG. 3. For example, front plates 51H, 52H are made of metal in order to provide rigidity and solidity. FIG. 1 and FIG. 2 illustrate upper front block 50H after its various parts are assembled. Front spacer 53H has a constant thickness (along vertical axis Z), which allows maintaining a constant distance between the two front plates 51H, 52H.

Advantageously, front spacer 53H is a single part and has at its center a closed front wall 531H which surrounds central front hole 521H after assembly of upper front block 50H, as illustrated in FIG. 3. Front wall 531H contributes to preventing, during the overmolding of insole 11, the material from filling central front hole 521H where tab 51B of lower front block 50H is to be fixed (see below). Similarly, in the embodiment where sole 10 is one piece, front wall 531H contributes to preventing, during the molding of sole 10, the material from filling central front hole 521H.

Alternatively, front spacer 53H is in multiple parts. For example, front spacer 53H is composed of several disjoint tubes, each tube surrounding one of the mechanical connection elements (for example rivets) of front plates 51H, 52H. This situation is illustrated in FIGS. 7 and 8.

Upper rear block 60H comprises an upper rear plate 61H, a lower rear plate 62H pierced with a central rear hole 621H and a side rear hole 622H, and a rear spacer 63H which is located between rear plates 61H, 62H. Side rear hole 622H is located more forward than central rear hole 621H. Rear plates 61H, 62H and rear spacer 63H extend in horizontal plane X, Y and are mechanically connected together along vertical axis Z. This mechanical connection is achieved for example by riveting with rivets which pass through holes in each of rear plates 61H, 62H and in rear spacer 63H, as illustrated in FIG. 3. For example, rear plates 61H, 62H are made of metal. FIG. 1 and FIG. 2 illustrate upper rear block 60H after assembly of its various parts. Rear spacer 63H has a constant thickness (along vertical axis Z), which allows maintaining a constant distance between the two rear plates 61H, 62H.

Advantageously, rear spacer 63H is a single part and has a closed rear central wall 631H at its center, which surrounds central rear hole 621H after assembly of upper rear block 60H, as illustrated in FIG. 3. Rear central wall 631H contributes to preventing, during the overmolding of insole 11, the material from filling central rear hole 621H where hook 64B of lower rear block 60H will be fixed (see below). The rear spacer also has, at its front portion, a closed rear side wall 632H which surrounds side rear hole 622H after assembly of upper rear block 60H, as illustrated in FIG. 3. Rear side wall 632H helps to prevent, during the overmolding of insole 11, the material from filling side rear hole 622H where tip 65B of lower rear block 60B is to be housed (see below). Similarly, in the embodiment where sole 10 is one piece, rear central wall 631H and rear side wall 632H contribute to preventing, during the molding of sole 10, the material from filling central rear hole 621H and side rear hole 622H.

Alternatively, rear spacer 63H is in multiple parts. For example, rear spacer 63H is composed of several disjoint tubes, each tube surrounding one of the mechanical connection elements (for example rivets) of rear plates 61H, 62H. This situation is illustrated in FIGS. 7 and 8.

As illustrated in FIGS. 2 to 4, after its molding, outsole 12 has a front hole 125 surrounded by a front wall 1251 and intended to accommodate lower front plate 52H. During assembly, upper front plate 51H rests on front wall 1251, and lower front plate 52H is housed in front hole 125 and is open to outer face 122 of outsole 12. Front wall 1251 helps to prevent, during the overmolding of insole 11, the material from filling central front hole 521H. Similarly, outsole 12 has, after its molding, a rear hole 126 surrounded by a rear wall 1261 and intended to accommodate lower rear plate 62H. During assembly, upper rear plate 61H rests on rear wall 1261, and lower rear plate 62H is housed in rear hole 126 and is open to outer face 122 of the outsole. Rear wall 1261 helps to prevent, during the overmolding of insole 11, the material from filling central rear hole 621H and side rear hole 622H. FIG. 4 illustrates upper blocks 50H, 60H assembled with outsole 12, before the overmolding of insole 11.

Lower front plate 52H and lower rear plate 62H are open to the lower face of sole 10 (outer face 122) without extending beyond it, so as not to interfere with the user's walking when transport portion 2 is not secured to footwear portion 1.

Advantageously, upper front plate 51H has front reliefs 511H and upper rear plate 61H has rear reliefs 611H. These reliefs help to hold upper blocks 50H and 60H in place on outsole 12 during the overmolding of insole 11. For example, these reliefs are notches which are located on the periphery of upper plates 51H, 61H, as illustrated in FIGS. 1 to 4. Similarly, in the embodiment where sole 10 is one piece, these reliefs contribute to holding upper blocks 50H and 60H in place during the molding of sole 10.

Additionally or alternatively, upper plates 51H, 61H have depressions or holes on their upper face, in which pins are housed. These pins contribute to holding upper blocks 50H and 60H in place on outsole 12 during the overmolding of insole 11. Similarly, in the embodiment where sole 10 is one piece, these pins contribute to holding upper blocks 50H and 60H in place during the molding of sole 10.

FIG. 5 and FIG. 6 illustrate lower plates 52H, 62H housed in holes 125, 126 after the overmolding of insole 11. During this overmolding, the material covers and surrounds upper front plate 51H and upper rear plate 61H such that these plates are housed in a front cavity 115 and a rear cavity 116 on lower face 112 of insole 11. In FIG. 6, insole 11 is detached from outsole 12 in order to show these cavities. In FIG. 5, the finalized sole 10 is shown after the overmolding of insole 11 onto outsole 12.

The molding of sole 10, for example the molding of insole 11 and the overmolding of outsole 12, is performed with a thermoplastic polymer or a thermosetting polymer.

For example, a thermoplastic elastomer ("Thermoplastic Rubber", TR) is used as the polymer, with an injection temperature of between 160° C. and 210° C., an injection pressure of between 20 bar and 80 bar, and an injection duration of between 90 seconds and 120 seconds.

For example, a thermoplastic polyurethane ("Thermoplastic PolyUrethane", TPU) is used as the polymer, with an injection temperature of between 150° C. and 190° C., an injection pressure of between 20 bar and 120 bar, and an injection duration of between 240 seconds and 300 seconds.

Advantageously, footwear portion 1 further comprises a retaining element 13, also called an assembly inner sole, which makes it possible to maintain a substantially constant longitudinal distance (spacing) over time between upper front block 50H and upper rear block 60H. Thus, retaining element 13 extends in a plane (horizontal plane X, Y at rest) and is flexurally deformable and tensionally non-deformable, meaning under stresses within its plane at rest. "Deformable" is understood to mean easily deformable with bare hands. "Non-deformable" is understood to mean it cannot be visibly deformed with bare hands.

For example, retaining element 13 is a plastic sheet attached to insole 11 (or to sole 10) and located above insole 11 (or above sole 10), with reference to the vertical axis Z. Retaining element 13 is fixed to the top of insole 11 (or sole 10), for example by gluing and/or sewing. Alternatively, retaining element 13 is fixed under the upper (not shown) of footwear portion 1, this upper then being fixed to insole 11 (or to sole 10) as described above. In these cases, block 50H and block 60H are not linked directly by retaining element 13 but indirectly by means of insole 11 (or sole 10). Retaining element 13 contributes to preventing deformation of insole 11 (or sole 10) within its plane when at rest (horizontal plane X,Y). Retaining element 13 is illustrated in FIG. 3.

For example, retaining element 13 is a pair of plastic sheets 131, 132 which sandwich upper plates 51H, 61H, as shown in FIG. 7. This pair of sheets comprises an upper sheet 131 and a lower sheet 132. Lower sheet 132 has front and rear holes to allow spacers 53H, 63H to pass through them, lower plates 52H, 62H being located below lower sheet 132. Upper sheet 131 and lower sheet 132 are assembled by heating and pressure in a manner that embeds upper plates 51H, 61H between them.

Alternatively, retaining element 13 is a plastic or metal strip which is located above upper blocks 50H, 60H, as shown in FIG. 8. In all cases, retaining element 13 is fixed directly to upper plates 51H, 61H. For example, this is achieved by riveting. Advantageously, the rivets which are used to rivet each of upper blocks 50H, 60H are used for this riveting.

Secondly, lower front block 50B and lower rear block 60B of securing mechanism 40 are now described.

Lower front block 50B and lower rear block 60B are integrated into frame 30. Frame 30 is substantially planar and extends in a horizontal plane X, Y and is non-deformable under tension and compression, meaning to forces within its plane while at rest, which makes it possible to maintain a constant distance between lower front block 50B and lower rear block 60B. Advantageously, frame 30 comprises an upper shell 31 and a lower shell 32 which can be mechanically secured together in a removable manner. The assembly of lower front block 50B and lower rear block 60B to frame 30 is thus made easier. FIG. 9 illustrates these various parts in an exploded perspective view, before their assembly into their correct positions.

Lower front block 50B has a base which is extended upwards by a tab 51B having a distal end which curves forward to form a hook. Lower front block 50B can be seen in FIG. 9. For example, lower front block 50B is one piece, which facilitates its manufacture.

Lower rear block 60B comprises a guide 61B, a support 62B, a carriage 63B, a pair of hooks 64B each having an upper end which curves rearward and has a convex top, a stop member 65B, and a spring 66B. FIG. 10 illustrates an exploded perspective view of these various parts of lower rear block 60B before their assembly into their correct positions. The case of a pair of 64B hooks is described below. Alternatively, there may be a single hook 64B or more than two hooks 64B.

The assembly of front block 50B and lower rear block 60B with frame 30 is described below.

Front block 50B is placed on the upper face of lower shell 32 in a housing located at the front such that front block 50B is integral with lower shell 32 in a horizontal plane X,Y. Support 62B is placed on the upper face of lower shell 32 in a housing located at the rear such that support 62B is integral with lower shell 32 in a horizontal plane X,Y. Front block 50B is oriented so that the distal end of tab 51B is directed forward. This step is illustrated in FIG. 11.

Next, upper shell 31 is placed on lower shell 32. The base of lower front block 50B is sandwiched between these shells 31, 32 such that lower front block 50B is prevented from vertical movement by shells 31, 32. Upper shell 31 has a hole at the front which tab 51B passes through so that tab 51B extends upwards above the upper face of upper shell 31. The periphery of support 62B is sandwiched between shells 31, 32, such that support 62B is prevented from vertical movement by shells 31, 32. Upper shell 31 has a rear hole 316 at the rear which leaves accessible the central portion of support 62B, and in particular two parallel side slots 624B and two slots 623B, front and rear, which all traverse this central portion. These four slots 624B, 623B extend along longitudinal axis X. This step is illustrated in FIG. 12.

Next, upper shell 31 and lower shell 32 are assembled mechanically. For example, the assembly is achieved by screws—nuts, the screws traversing through-holes in upper shell 31 and lower shell 32. In FIG. 12 and subsequent figures, there are two holes located towards the front of frame 30 and two holes located towards the rear of frame 30. For example, the screws also traverse a portion of movement mechanism 80, and serve to secure movement mechanism 80 to frame 30.

Stop member 65B is then inserted into the front portion of rear hole 316 of upper shell 31. The front portion of rear hole 316 is shaped to match the lower portion of stop member 65B so that stop member 65B is kept vertical and is prevented from movement within horizontal plane X, Y. The upper portion of stop member 65B projects above the upper face of upper shell 31. Advantageously, this upper portion of stop member 65B is pointed. This step is illustrated in FIG. 13.

Hooks 64B are then assembled with carriage 63B. Carriage 63B has two slots 634B in its central portion. Hooks 64B are inserted vertically into these slots from bottom to top so that the upper portion of hooks 64B protrudes above carriage 63B. Hooks 64B have two arms 643B at their middle which extend forwards and rearwards and are each curved upwards at their distal end, and on which rests the central portion of carriage 63B. Hooks 64B are thus prevented from translational movement within horizontal plane X, Y relative to carriage 63B (by slots 634B, and with the aid of arms 643B which block the central portion of carriage 63B), and are prevented from upward vertical translational movement, but not downward. The central portion of carriage 63B is extended at the front and rear by two downwardly curving tabs 632B. Hooks 64B and carriage 63B with their various parts can be seen in FIG. 10.

The assembly composed of hooks 64B and carriage 63B is then placed in rear hole 316 of upper shell 31. This assembly is located rearward of stop member 65B. The lower end of each of hooks 64B is inserted into one of side slots 624B so that hooks 64B are able to slide longitudinally within side slots 624B. The lower end of each of tabs 632B is inserted into one of front and rear slots 623B so that these hooks 632B are able to slide longitudinally in front and rear slots 623B. This step is illustrated in FIG. 14.

Spring 66B is then placed in rear hole 316 of upper shell 31. The front end of spring 66B rests against stop member 65B, and the rear end against front tab 632B of carriage 63B. At rest, or slightly compressed, spring 66B therefore pushes carriage 63B rearward until rear tab 632B of carriage 63B abuts against the rear edge of rear hole 316. This step is illustrated in FIG. 15.

Rear hole 316 is then covered by guide 61B. Guide 61B has, in its central portion, two parallel slots 614B which extend longitudinally and which are traversed by the upper ends of hooks 64B. Guide 61B thus covers carriage 63B and spring 66B so that carriage 63B, hooks 64B, and spring 66B are prevented from upward vertical translational movement along axis Z. Guide 61B has a notch 615B at its front end, which is traversed by the upper portion of stop member 65B. Stop member 65B has two transverse shoulders 651B in its central portion, which the transverse edges of notch 615B rest against, such that stop member 65B is prevented from upward vertical translational movement along Z. This step is illustrated in FIG. 16.

Guide 61B is then mechanically secured to support 62B. For example, this is achieved by riveting with rivets, as shown in FIG. 16. Given that support 62B is secured to frame 30 and that horizontal and vertical movement relative to frame 30 is prevented as explained above, the entire lower rear block 60B is secured to frame 30 and its vertical and horizontal movement is blocked between lower shell 32 and upper shell 31 of frame 30, with the exception of hooks 64B (or more generally the at least one hook 64B if there is only one, two, three, or more) which are only capable of longitudinal translation along axis X within slots 614B.

The process of securing footwear portion 1, after its assembly, to frame 30, after its assembly, is described below.

The front of outsole 12 (or sole 10) is placed in contact with the front of the upper face of frame 30 until the distal end of tab 51B of lower front block 50B engages in central front hole 521H of lower front plate 52H. Then outsole 12 (or sole 10) is moved translationally rearward relative to frame 30 until the distal end of tab 51B passes above the front edge of central front hole 521H, so that tab 51B is joined to upper front block 50H.

Then the rear of outsole 12 (or sole 10) is lowered vertically against the rear of the upper face of frame 30 until hooks 64B penetrate central rear hole 621H of upper rear plate 62H. At the same time, tip 65B of lower rear block 60B enters side rear hole 622H of upper rear plate 62H. The rear edge of central rear hole 621H then presses against the convex top of each of hooks 64B, pushing them forward against spring 66B. The rear of outsole 12 continues to be moved vertically closer to frame 30 until the rear edge of central rear hole 621H passes below the upper end of each of hooks 64B. Spring 66B then pushes hooks 64B rearward so that the rear edge of central rear hole 621H is sandwiched between the upper end of hooks 64B and the guide 61B. Hooks 64B are thus secured to upper rear block 60H. Footwear portion 1 is thus made vertically and horizontally integral with frame 30, by tab 51B and hooks 64B.

The method of detaching footwear portion 1 from frame 30 is described below.

Frame 30 has a rectilinear channel 306 which is formed between upper shell 31 and lower shell 32 and which extends horizontally rearward from rear hole 316 and leads to the rear of frame 30, as illustrated in FIGS. 11 and 12. The rod of a tool (not shown) is inserted via channel 306 until the end of this rod pushes forward rear tab 632B of carriage 63B, compressing spring 66B. Hooks 64B are thus pushed forward, which disengages the rear edge of central rear hole 621H from hooks 64B. The rear edge of footwear portion 1 can then be lifted away from frame 30, then footwear portion 1 is moved forward relative to frame 30 in order to disengage tab 51B from central front hole 521H. Footwear portion 1 is thus entirely detached from frame 30.

Other embodiments of the invention are possible, for example the entire lower rear block 60B is sandwiched between lower shell 32 and upper shell 31 except for the at least one hook 64B, and is locked in place between these shells 31, 32 by the mechanical assembly of these shells. In this case, upper shell 31 partially covers guide 61B. Generally speaking, the entire lower front block 50B is sandwiched between upper shell 31 and lower shell 32 with the exception of at least tab 51B, and the entire lower rear block 60B is sandwiched between upper shell 31 and lower shell 32 with the exception of at least the at least one hook 64B.

In view of the above description, the method for manufacturing a sports equipment device according to the invention, having a footwear portion 1 and a frame 30, comprises the following steps:

An upper front block 50H and an upper rear block 60H are provided, and a sole 10 is manufactured which is part of a footwear portion 1 of which at least a portion is molded onto the upper front block and the upper rear block such that these upper blocks 50H, 60H are integrated into sole 10 (step (b));

A frame 30 is assembled with a lower front block 50B and a lower rear block 60B such that lower blocks 50B, 60B are attached to frame 30 (step (c));

A movement mechanism 80 is fixed under frame 30 (step (d));

Then lower front block 50B is secured to upper front block 50H and lower rear block 60B is secured to upper rear block 60H, such that footwear portion 10 is removably secured to frame 30 (step (e)).

In one particular embodiment, before step (b), an outsole 12 is manufactured by molding (step (a)).

In step (b), an insole 11 is overmolded onto outsole 12 and onto upper front block 50H and upper rear block 60H. Sole 10 comprises outsole 12 and insole 11.

The invention claimed is:

1. A sports equipment device, comprising:
a footwear portion comprising a sole;
a transport portion comprising
a frame which extends along a longitudinal axis oriented from front to rear, and
a movement mechanism configured to move across the ground which is fixed under the frame; and
a securing mechanism configured to removably secure the footwear portion to the frame, the securing mechanism comprising
a front attachment mechanism comprising
an upper front block attached to the footwear portion, the upper front block comprising
an upper front plate,
a lower front plate pierced with a central front hole, and
a front spacer disposed between said front plates, said front plates and said front spacer being mechanically connected together, and
a lower front block attached to the frame and configured to be secured to the upper front block, and
a rear attachment mechanism comprising
an upper rear block attached to the footwear portion, the upper rear block comprising
an upper rear plate,
a lower rear plate pierced with a central rear hole and a side rear hole, and
a rear spacer located between said rear plates, said rear plates and said rear spacer being mechanically connected together, and
a lower rear block attached to the frame and configured to be secured to the upper rear block,
wherein said upper front block and said upper rear block are integrated into said sole, and
wherein at least a portion of said sole is created by molding and is molded onto said upper front block and said upper rear block.

2. The sports equipment device according to claim 1, wherein the footwear portion further comprises a retaining element which extends within a plane when at rest and which is flexurally deformable and tensionally non-deformable in the plane.

3. The sports equipment device according to claim 2, wherein said retaining element is fixed directly to said upper front block and said upper rear block.

4. The sports equipment device according to claim 1, wherein the front spacer is a single part and has a closed front wall at the center of the front spacer which surrounds said front hole, and the rear spacer has a closed rear central wall at the center of the rear spacer which surrounds said central rear hole and on the front portion of the rear spacer has a closed rear side wall which surrounds the side rear hole.

5. The sports equipment device according to claim 1, wherein said upper front plate has front reliefs, and said upper rear plate has rear reliefs.

6. The sports equipment device according to claim 1, wherein said sole comprises
an outsole which has an outer face, and
an insole, which are each created by molding, said insole being overmolded onto said outsole and onto said upper front block and said upper rear block.

7. The sports equipment device according to claim 6, wherein said outsole has a front hole surrounded by a front wall in which said lower front plate is housed, which opens onto said outer face, and has a rear hole surrounded by a rear wall in which said lower rear plate is housed, which opens onto said outer face.

8. The sports equipment device according to claim 1, wherein said frame comprises an upper shell and a lower shell configured to be mechanically secured together in a removable manner.

9. A method for manufacturing a sports equipment device, the method comprising:
providing an upper front block and an upper rear block, the upper front block comprising
an upper front plate,
a lower front plate pierced with a central front hole, and
a front spacer located between said front plates,
said upper and lower front plates and said front spacer being mechanically connected together, and
the upper rear block comprising
an upper rear plate,
a lower rear plate pierced with a central rear hole and a side rear hole, and
a rear spacer located between said rear plates, said rear plates and said rear spacer being mechanically connected together; and
manufacturing a sole in which at least a portion is molded onto said upper front block and said upper rear block such that said upper blocks are integrated into said sole which is part of a footwear portion;
providing a frame, a lower front block, and a lower rear block, and attaching said lower blocks to said frame;
fixing a movement mechanism under said frame; and
securing the lower front block to the upper front block and securing the lower rear block to the upper rear block to removably secure the footwear portion to the frame.

10. The method for manufacturing according to claim 9, further comprising:

before providing the upper front block and the upper rear block, manufacturing an outsole by molding, wherein said sole comprises said outsole and an insole which is created by molding, said insole being over-molded onto said outsole and onto said upper front block and said upper rear block.

* * * * *